US007097359B2

(12) United States Patent
Plourde et al.

(10) Patent No.: US 7,097,359 B2
(45) Date of Patent: Aug. 29, 2006

(54) RECLOSABLE PACKAGING HAVING SLIDER COUPLED TO TOP OF ZIPPER

(75) Inventors: Eric Paul Plourde, Homewood, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 77 days.

(21) Appl. No.: 10/371,031

(22) Filed: Feb. 20, 2003

(65) Prior Publication Data

US 2004/0165794 A1 Aug. 26, 2004

(51) Int. Cl.
*B65D 33/16* (2006.01)
*A44B 19/16* (2006.01)

(52) U.S. Cl. ..... 383/63; 24/399; 24/400

(58) Field of Classification Search ..... 24/30.5 R, 24/399, 400; 383/64, 63
See application file for complete search history.

(56) References Cited

U.S. PATENT DOCUMENTS 2,581,604 A * 1/1952 Roehri ..... 24/400
2,696,032 A 12/1954 Sander
3,259,951 A * 7/1966 Zimmerman ..... 24/399
3,579,747 A 5/1971 Hawley
6,571,430 B1 * 6/2003 Savicki et al. ..... 24/30.5 R
6,611,997 B1 * 9/2003 Savicki ..... 24/400
6,728,997 B1 * 5/2004 Savicki et al. ..... 24/399
6,786,641 B1 * 9/2004 Plourde ..... 383/64
6,826,808 B1 * 12/2004 Kutschka ..... 24/427
2003/0172501 A1 * 9/2003 Kutschka
2003/0194155 A1 10/2003 Plourde
2003/0235351 A1 * 12/2003 Plourde

FOREIGN PATENT DOCUMENTS

WO WO 02/21959 A 3/2002
WO WO 02/47986 A 6/2002

* cited by examiner

*Primary Examiner*—Robin A. Hylton
(74) *Attorney, Agent, or Firm*—Ostrager Chong Flaherty & Broitman P.C.

(57) ABSTRACT

A slider-zipper assembly for reclosable packaging in which the slider is coupled to the top portions of the zipper parts. The zipper can be either a flanged zipper or a string (i.e., webless) zipper. In one embodiment, the slider has a pair of diverging profiled projections that fit in and interlock with respective profiled grooves in the zipper parts. In another embodiment, the slider has a pair of diverging profiled grooves that receive and interlock with respective profiled projections that project upwardly from the zipper parts. Alternatively, the slider could have one projection and one groove for interlocking with the respective zipper parts. The diverging profiles on the slider cause adjacent sections of the zipper to open as the slider is moved in the zipper opening direction. Alternatively, the projections on the slider could be discontinuous.

19 Claims, 6 Drawing Sheets

RECLOSABLE PACKAGING HAVING SLIDER COUPLED TO TOP OF ZIPPER

BACKGROUND OF THE INVENTION

This invention generally relates to slider-operated flexible zippers for use in reclosable pouches, bags or other packages of the type in which perishable material, such as foodstuff, may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 6,047,450 discloses a zipper comprising a pair of mutually interlockable zipper profiles, portions of which form a fulcrum about which the zipper halves may be pivoted out of engagement. This is accomplished by a slider that straddles the zipper and has an opening end designed to force lower edges of the bases of the zipper halves towards each other, causing the interlocked zipper profiles to pivot in opposite directions about the fulcrum point and thereby disengage.

It is also known to provide sliders that do not straddle the zipper. For example, U.S. patent application Ser. No. 10/175,188 discloses a slider-operated zipper assembly for reclosable packaging in which the slider is mounted inside the zipper. This slider-zipper assembly design allows packaging film to be sealed directly to the exterior or backs of the zipper parts without interfering with the operation of the slider. Being able to seal the packaging film to the outside of the zipper parts makes it easier to incorporate header features that are typically used to provide evidence of tampering. Conventional extension flanges are not needed when the packaging film is joined to the backs of the zipper profiles.

There is a need for further improvements in slider-zipper assembly designs that allow packaging film to be sealed directly to the exterior of the zipper parts.

BRIEF DESCRIPTION OF THE INVENTION

The invention is directed to a slider-zipper assembly for reclosable packaging in which the slider is coupled to the top portions of the zipper parts. In one type, a slider with sidewalls straddles the profiles of flanged zipper parts. In another type, a top slider without sidewalls overlies a string (i.e., webless) zipper and the bag film is sealed to the backs of the zipper parts. However, it is within the scope of the invention to use a slider of the straddling type with a string zipper and to use a top slider with a flanged zipper.

In one embodiment, the slider has a pair of diverging profiled projections that fit in and interlock with respective profiled grooves in the zipper parts. In another embodiment, the slider has a pair of diverging profiled grooves that receive and interlock with respective profiled projections that project upwardly from the zipper parts. Alternatively, the slider could have one projection and one groove for interlocking with the respective zipper parts. The diverging profiles on the slider cause adjacent sections of the zipper to open as the slider is moved in the zipper opening direction. Alternatively, the projections on the slider could be discontinuous.

Another aspect of the invention is an article of manufacture comprising first and second mutually interlockable profiled zipper parts joined along respective end sections to form a zipper, and a slider mounted to the zipper and movable between first and second slider park positions for engaging or disengaging mutually confronting portions of the first and second zipper parts. The first zipper part comprises a first profiled groove that opens onto a top surface of the first zipper part, while the second zipper part comprises a second profiled groove that opens onto a top surface of the second zipper part. The slider comprises a base and first and second profiled projections depending from the base, the base being disposed above the tops of the first and second zipper parts. The first profiled projection is inserted in and interlocked with the first profiled groove in the first zipper part, and the second profiled projection is inserted in and interlocked with the second profiled groove in the second zipper part. The first and second profiled projections slide in the first and second profiled grooves respectively during slider travel along the zipper.

A further aspect of the invention is an article of manufacture comprising first and second mutually interlockable profiled zipper parts joined along respective end sections to form a zipper, and a slider mounted to the zipper and movable between first and second slider park positions for engaging or disengaging mutually confronting portions of the first and second zipper parts. The first zipper part comprises a first profiled projection that projects upward from a top surface of the first zipper part, while the second zipper part comprises a second profiled projection that projects upward from a top surface of the second zipper part. The slider comprises a base and first and second profiled grooves formed in the base, the base being disposed above the tops of the first and second zipper parts. The first profiled projection of the first zipper part is inserted in and interlocked with the first profiled groove, and the second profiled projection of the second zipper part is inserted in and interlocked with the second profiled groove. The first and second profiled grooves slide along the first and second profiled projections respectively during slider travel along the zipper.

Yet another aspect of the invention is an article of manufacture comprising first and second mutually interlockable profiled zipper parts joined along respective end sections to form a zipper, and a slider mounted to the zipper and movable between first and second slider park positions for engaging or disengaging mutually confronting portions of the first and second zipper parts. The first zipper part comprises a first profile and the second zipper part comprises a second profile that mates with the first profile. The slider comprises a base overlying the first and second zipper parts and bridging an interstice between the first and second zipper parts. The article further comprises means for coupling the slider to the first and second zipper parts, the coupling means allowing the slider to slide along the zipper in opening and closing directions, and means for stopping the slider at zipper maximally opened and zipper maximally closed slider park positions respectively. The coupling means comprise the following elements: first and second profiled projections that project generally or almost perpendicular to the slider base when the slider and zipper are coupled, and first and second profiled grooves that receive and interlock with the first and second profiled projections respectively. Two of the four coupling elements are disposed on the slider, one is disposed on the first zipper part, and one is disposed on the second zipper part.

Another aspect of the invention is an article of manufacture comprising first and second mutually interlockable profiled zipper parts joined along respective end sections to form a zipper, and a slider mounted to the zipper and movable between first and second slider park positions for engaging or disengaging mutually confronting portions of the first and second zipper parts. The first zipper part comprises a first profiled groove that opens onto a top surface of the first zipper part, while the second zipper part comprises a second profiled groove that opens onto a top surface of the second zipper part. The slider comprises a base and first through fourth profiled projections depending from the base, the base being disposed above the tops of the first and second zipper parts. The first and third profiled projections are inserted in and interlocked with the first profiled groove in the first zipper part, while the second and fourth profiled projections are inserted in and interlocked with the second profiled groove in the second zipper part. The first through fourth profiled projections slide in the first and second profiled grooves during slider travel along the zipper, the first and second profiled projections being separated by a first distance, and respective portions of the third and fourth profiled projections that are furthest apart being separated by a second distance greater than the first distance. The first and second distances are measured in a direction transverse to a direction of travel of the slider, the second distance being great enough to cause adjoining sections of the first and second zipper parts to disengage.

Further aspects of the invention include various reclosable packages comprising a receptacle that is opened and closed using a slider-zipper assembly having any one of the structures generally described in the preceding four paragraphs.

Other aspects of the invention are disclosed and claimed below.

BRIEF DESCRIPTION OF THE DRAWINGS

FIG. 3 shows a section taken in a plane that is coplanar with the opening end of the slider; FIG. 4 shows a section taken in a plane that is coplanar with the closing end of the slider. [To facilitate the reader's understanding, structure that would ordinarily be visible behind the plane of sectioning has not been shown. Also, although the view in FIG. 3 is opposite to the view seen in FIG. 2, the positions of the male and female profiles have not been reversed for ease in comparison of these figures.]

Reference will now be made to the drawings in which similar elements in different drawings bear the same reference numerals.

DETAILED DESCRIPTION OF THE INVENTION

Figure 1:
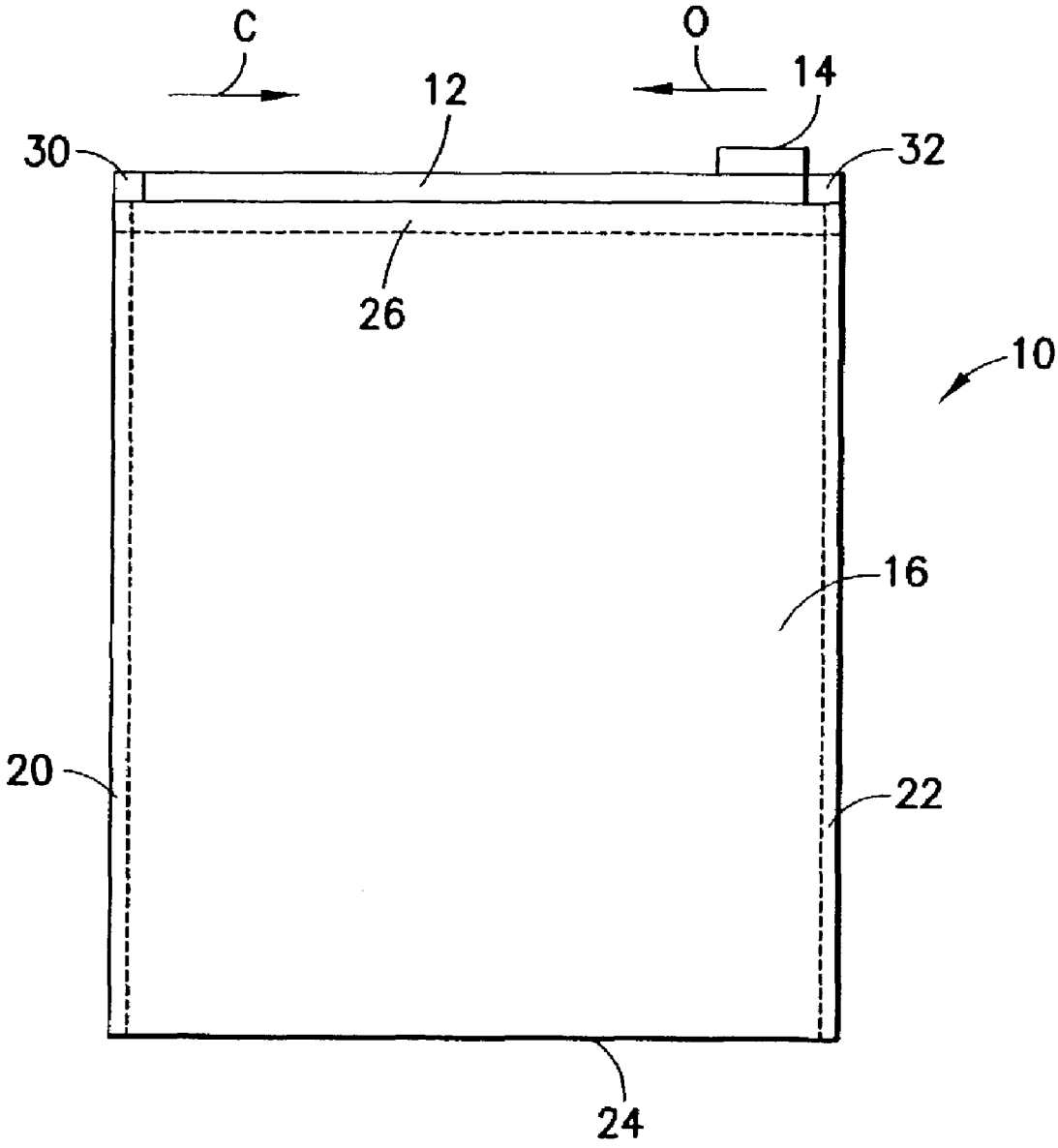
FIG. 1 is a schematic showing a front elevational view of a reclosable package having a slider-operated flexible zipper in accordance with various embodiments of the present invention.

FIG. 1 shows a reclosable bag 10 having a flexible plastic zipper 12 operated by manipulation of a slider 14 in accordance with various embodiments of the invention. While the embodiments differ in the structure for coupling the slider to the zipper, they share the common feature that the coupling means are disposed on the tops of the zipper parts and on the bottom of the base or roof of the slider. The bag 10 may be made from any suitable sheet material or plastic film and comprises opposite wall panels (only one of which, namely front wall panel 16, is visible in FIG. 1), which may be secured together at opposite side edges of the bag by side heat seals 20 and 22. The opposing bottoms of the wall panels may be joined, for example, by means of a heat seal made in conventional fashion, e.g., by application of heat and pressure or ultrasonic energy. Typically, however, the bottom of the package is formed by a fold 24 in the original packaging film. Optionally, the bag may be provided with side gussets having respective junctures with the front and rear wall panels. In the latter case, the bag may also be provided with a bottom panel having respective junctures with the front and rear wall panels and with the side gussets.

At its top end, the bag 10 has an openable mouth, on the inside of which is an extruded plastic zipper 12. The zipper 12 comprises a pair of interlockable fastener strips or zipper halves. The interlocking profiles of the zipper halves may take any form. For example, the zipper may comprise interlocking rib and groove elements or alternating hook-shaped closure elements. The preferred zipper material is polyethylene. However, a different plastic material, such as polypropylene, could be used.

The front and rear bag wall panels are respectively sealed to the zipper halves by heat fusion or welding (also referred to herein as "heat sealing"). Alternatively, the interlockable zipper halves can be attached to the wall panels by adhesive or bonding strips or the zipper profiles can be extruded integrally with the bag material. For the purpose of joinder, each zipper half may be provided with a respective extension flange (only one of which, namely zipper flange 26, is indicated by a horizontal dashed line in FIG. 1), to which an upper portion of the respective bag wall panel is fused or welded. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

In zippered bags with sliders, as the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The slider 14 may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

A bag incorporating a zipper and a slider preferably includes means, such as end stops 30 and 32, for preventing the slider from sliding off the end of the zipper when the slider reaches the zipper maximally closed or maximally opened position. Such end stops perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, or any other suitable structure. The stomped end stops can be sections of the profiles that are fused together proximate to the open and closed slider positions such that the end stops are raised. Stomping can be carried out by, for example, applying heat and/or pressure or using ultrasonic methods.

The zipper halves preferably comprise interlocking rib and groove elements, which are well known in the art. The rib may have any profile that can be retained by the opposing lips at the mouth of the groove, e.g., triangular, trapezoidal, semicircular, and so forth. Many configurations of rib and groove elements may be employed to perform any one of a number of required functions. For instance, specific rib and groove elements may be employed to permit the package to be more easily opened from the outside than from the inside, so that the tension produced by the contents of the package will not accidentally open the rib and groove elements. The rib and groove elements may be carefully formed of a soft flexible material in part thereof so that the contents of the package are in fact relatively hermetically sealed from the outside.

Figure 2:
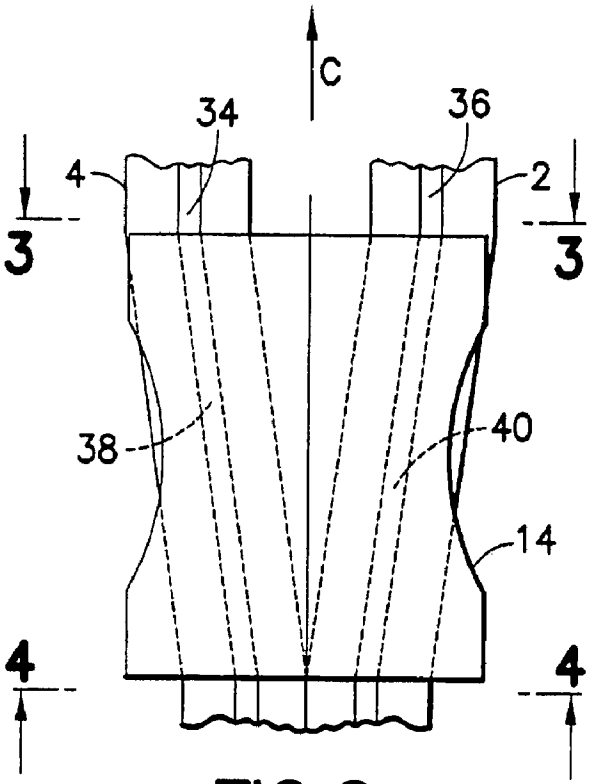
FIG. 2 is a schematic showing a fragmentary top view of a portion of a slider-zipper assembly in accordance with one embodiment of the invention.
Figure 3:
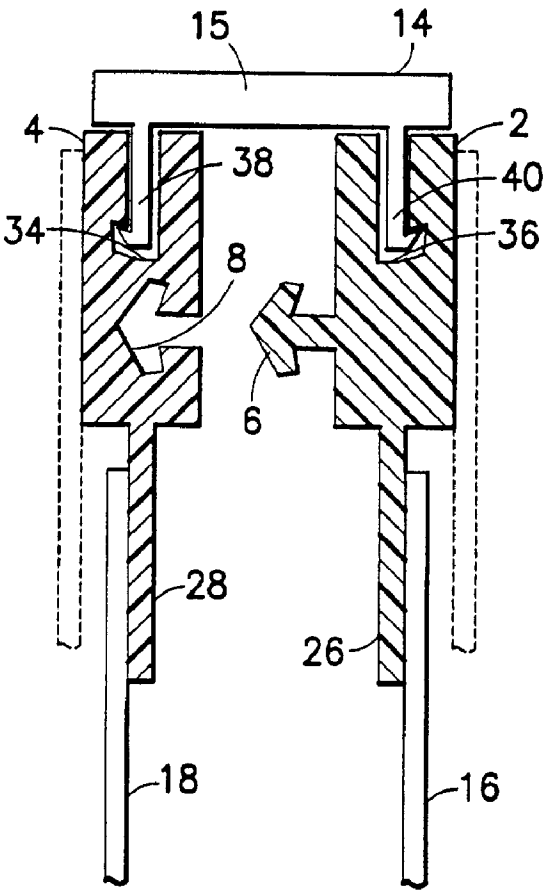
FIGS. 3 and 4 are schematics showing respective sectional views of the slider zipper assembly depicted in FIG. 2, the sections being taken along lines 3—3 and 4—4 indicated in FIG. 2.
Figure 4:
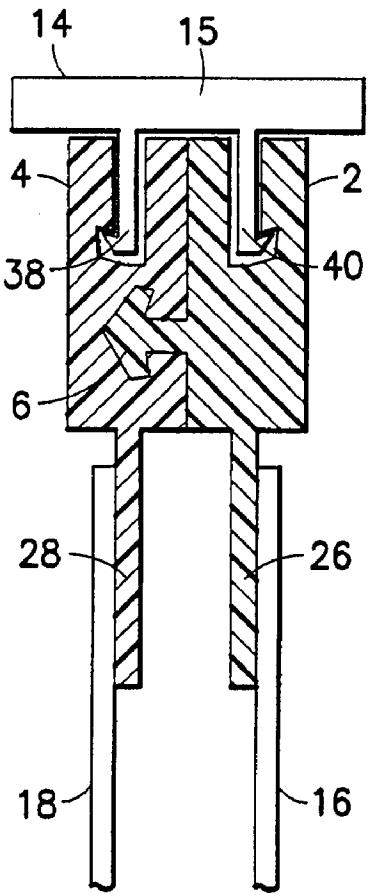

The present invention is directed to slider-zipper assemblies in which the slider is coupled to the top portions of the zipper parts. One embodiment of the invention is shown in FIGS. 2–4. FIG. 3 shows the zipper in an opened state; FIG. 4 shows the zipper in a closed state. The sectional views depicted in FIGS. 3 and 4 are taken along the lines 3—3 and 4—4 shown in the top view of FIG. 2. In this embodiment, the zipper comprises mutually interlockable zipper parts 2 and 4. The zipper part 2 comprises a base with a male profile (i.e., rib 6) and an extension flange 26 having one end connected to the base and depending downward therefrom, while zipper part 4 comprises a base having a female profile (i.e., groove 8) that mates with the male profile and an extension flange 28 having one end connected to the base and depending downward therefrom. The upper margins of the bag walls 16 and 18 are joined to the respective flanges 26 and 28 in a well-known manner, e.g., by heat sealing. Alternatively, the upper margins of the bag walls could be joined to the backs of the zipper parts (as indicated by dashed lines in FIG. 3) and the zipper flanges 26 and 28 could be eliminated to provide a so-called "string zipper" (i.e., a zipper having substantially no flanges) instead of a flanged zipper. Although not shown in FIGS. 2–4, the bag walls may be sealed at the sides in a conventional manner, and the ends of the zipper parts may be crushed and fused together in a conventional manner.

In this embodiment, the slider comprises a generally planar base 15 and a pair of profiled projections 38 and 40 depending downward from the bottom surface of the base 15. In this example, the projections have a hook-shaped profile. However, the profiles of the projections may be arrow-shaped, hook-shaped or any other shape ending in an enlarged head that is suitable for being gripped by a groove having a matching profile. As seen in FIG. 2, the projections 38 and 40 (indicated by dashed lines) extend in continuous fashion in mutually diverging relationship from a closing end of the slider to an opening end of the slider. The ends of the projections 38 and 40 nearest to the closing end of the slider are separated by a distance such that the adjacent sections of the zipper are closed. The ends of the projections 38 and 40 nearest to the opening end of the slider are separated by a distance such that the adjacent sections of the zipper are separated from each other enough to disengage the male and female profiles, thus opening that portion of the zipper.

Referring again to FIGS. 3 and 4, each zipper part has a groove, extending the length of the zipper part, for receiving a respective one of the slider projections 38 and 40. Each groove has a shape that interlocks with the distal end of the respective projection, providing resistance to pull-off of the slider. Zipper part 2 has a groove 36 that receives the projection 40, while the zipper part 4 has a groove 34 that receives the projection 38. The profiled projections 38 and 40 slide in the profiled grooves 34 and 36 respectively during slider travel along the zipper. As the slider is moved in the closing direction C (indicated by arrow C in FIG. 2), the mutually opposing inner side walls of projections 38 and 40, which are convergent relative to the zipper, push the adjacent sections of the zipper parts together and into engagement, i.e., the male and female profiles become interlocked. Conversely, as the slider is moved in the opening direction, the outer side walls of projections 38 and 40, which are divergent relative to the zipper, push or spread the adjacent sections of the zipper parts apart and out of engagement, i.e., the male and female profiles become disengaged.

As seen in FIG. 2, the slider base may be shaped to facilitate grasping between a thumb and an index finger. In the example shown in FIG. 2, the sides of the base 15 have concave curvature. In the alternative, ridges, knurls or serrations could be provided on the sides of the slider base.

Figure 5:
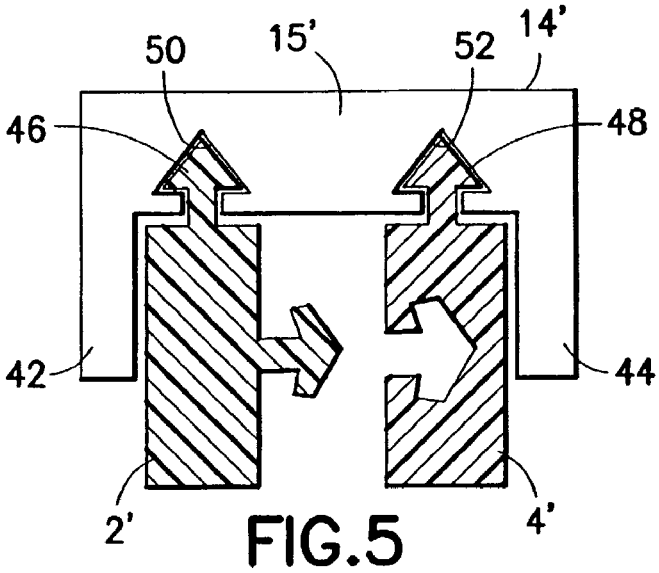
FIGS. 5–7 are schematics showing sectional views of respective slider-zipper assemblies in accordance with alternative embodiments of the invention.

In accordance with alternative embodiments of the invention, the positions of the projections and grooves can be reversed (i.e., projections on the zipper parts and grooves in the slider) and/or the slider can be provided with sidewalls. The addition of slider sidewalls provides a better grasping facility by the user and increases the slider pull-off resistance. An embodiment having both of these features is shown in FIG. 5. The slider 14' comprises a base 15' and a pair of sidewalls 42 and 44 connected to and extending downward from the respective sides of base 15'. The base 15' has a pair of grooves 50 and 52 that extend in continuous fashion in mutually diverging relationship from a closing end of the slider to an opening end of the slider, as previously described for the projections 38 and 40 in FIG. 2. The zipper part 2' has a profiled longitudinal projection 46 that extends along its length, while the zipper part 4' has a profiled longitudinal projection 48 that extends along its length. The slider is coupled to the zipper when a section of projection 46 on zipper part 2' is inserted in and interlocked with the groove 50, and a section of projection 48 on zipper part 4' is inserted in and interlocked with the groove 52. The slider 14' in effect rides on rails formed by projections 46 and 48. The ends of the grooves 50 and 52 nearest to the closing end of the slider are separated by a distance such that the adjacent sections of the zipper are closed during slider travel in the closing direction. The ends of the grooves 50 and 52 nearest to the opening end of the slider are separated by a distance such that the adjacent sections of the zipper are separated from each other enough to disengage the male and female profiles, thus opening that portion of the zipper during slider travel in the opening direction.

Figure 6:
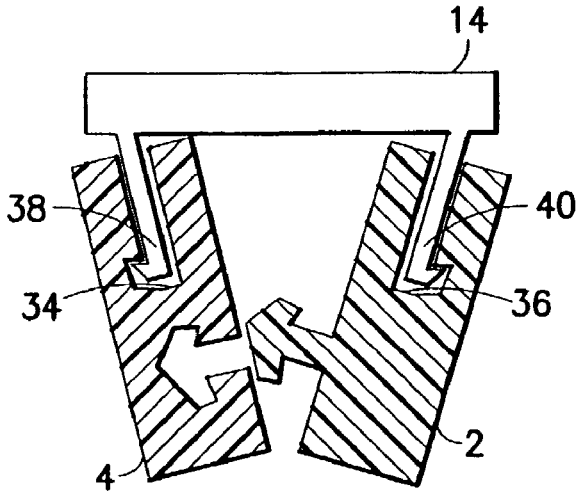
Figure 7:
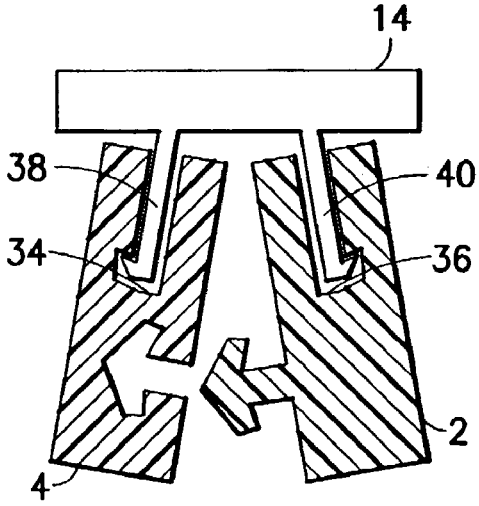

For embodiments in which the slider has projections that spread the zipper parts during opening, the spreader projections need not be vertical (i.e., need not be perpendicular to the slider base). Examples of slider with non-vertical spreader projections are shown in FIGS. 6 and 7, which show the opening end of respective sliders having angled continuous projections. Angled spreader projections help to open zippers with high internal opening forces.

Many reclosable bags having zippers operated by sliders have the characteristic that they are not completely leakproof when the zipper is closed and the slider is in the zipper-closed park position. Leakage is due to the fact that the zipper remains open in the region in front of the opening end of the slider, i.e., the zipper profiles remain separated in the region between the sealed end of the zipper and the opening end of the slider, even though the rest of the zipper is closed. However, watertightness of the reclosable package is required in numerous applications, for example, in reclosable bags used to store frozen foods.

Figure 8:
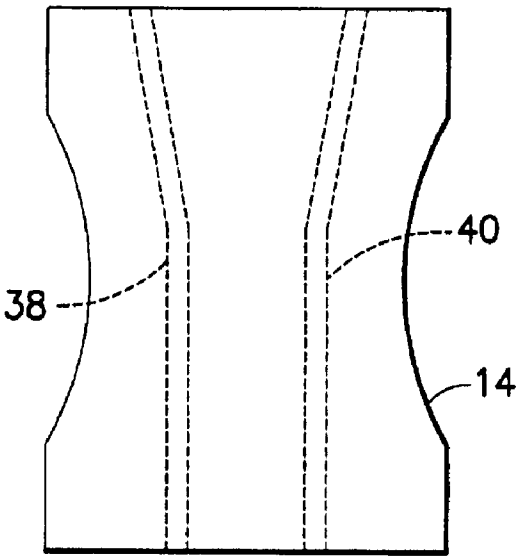
FIG. 8 is a schematic showing a top view of a slider having continuous projections in accordance with one embodiment of the invention.

FIG. 8 shows a top view of a slider having continuous projections 38 and 40 indicated by dashed lines. At the opening end of this slider, the ends of the projections 38 and 40 hold the adjoining sections of the zipper parts open. This is undesirable when the slider is parked at the zipper maximally closed position for the reasons stated in the previous paragraph.

Figure 9:
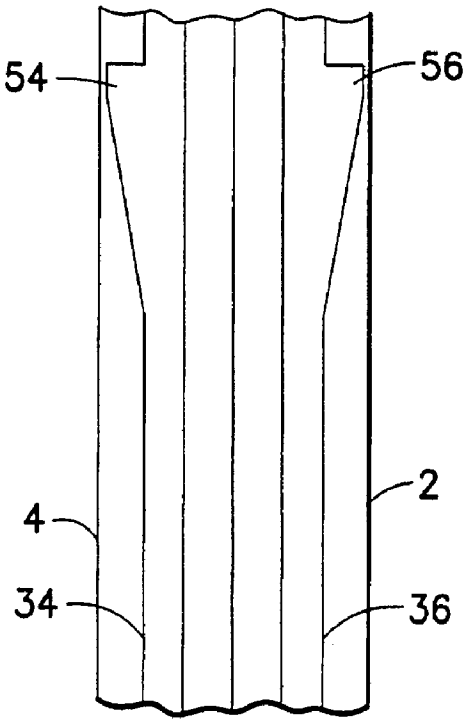
FIG. 9 is a schematic showing a fragmentary top view of a portion of a zipper for use with the slider depicted in FIG. 8.
Figure 11:
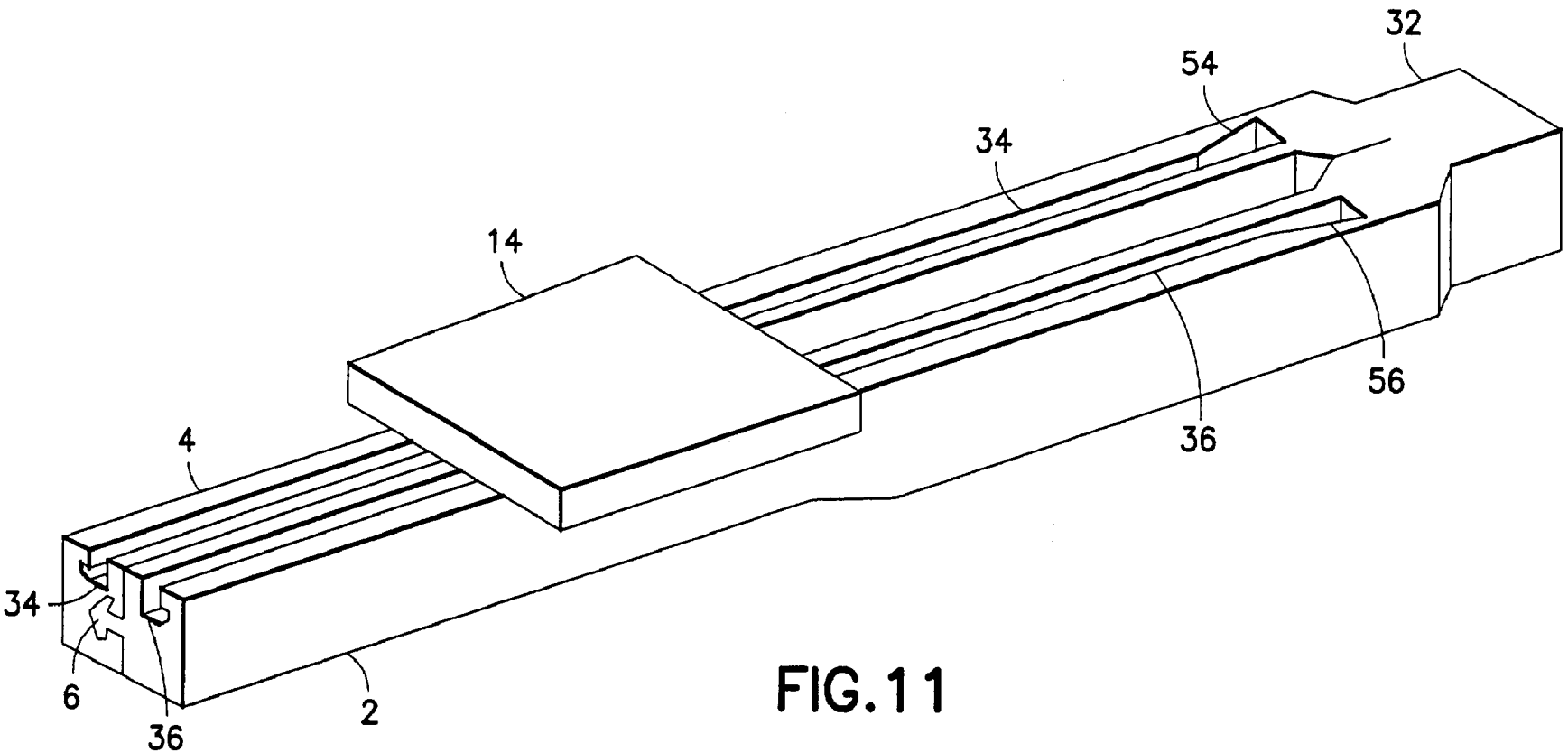
FIG. 11 is a schematic showing a fragmentary isometric view of the slider-zipper assembly depicted in FIG. 10.

FIG. 9 shows a top view of a portion of a zipper for use with the slider depicted in FIG. 8. The groove 34 in zipper part 4 has a widened region 54 at or near the end of the groove, while groove 36 in zipper part 2 has a widened region 56 at or near the end of the groove. Preferably the width of each groove increases linearly toward the end of the zipper. The widened portions 54 and 56 of the zipper grooves are proximal to a stomped end 32 of the zipper, seen in FIG. 11.

Figure 10:
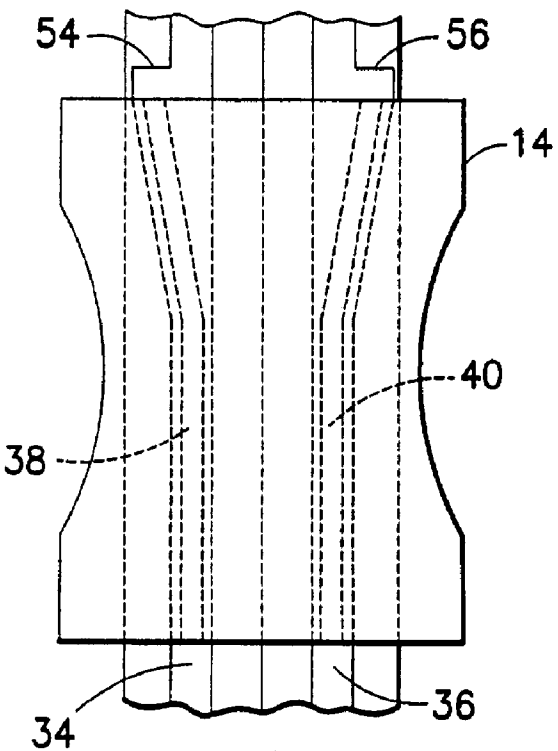
FIG. 10 is a schematic showing the slider of FIG. 8 mounted to the zipper shown in FIG. 9.

FIG. 10 shows the slider of FIG. 8 mounted to the zipper shown in FIG. 9. The widened portions 54 and 56 at the end of grooves 34 and 36 provide clearance for the diverging ends of the slider projections 38 and 40 respectively. As a result of this clearance, the opening end of the slider exerts no opening force on the zipper parts when the slider is parked in the zipper maximally closed position. This reduces the possibility of leakage through the zipper in the area of the slider park position.

Figure 12:
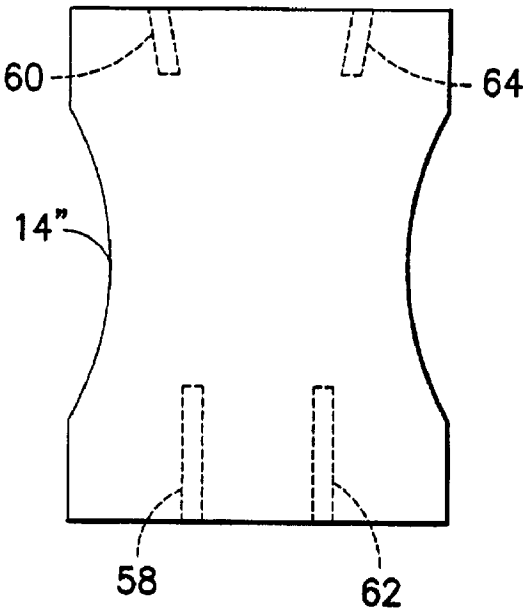
FIG. 12 is a schematic showing a top view of a slider having discontinuous projections in accordance with another embodiment of the invention.

For embodiments in which the slider has projections that spread the zipper parts during opening, the spreader legs or projections need not be continuous. An example of discontinuous projections on the slider is shown in FIG. 12. A first pair of profiled projections 58 and 62 are disposed underneath the slider base proximal to the closing end of the slider, while a second pair of profiled projections 60 and 64 are disposed underneath the slider base proximal to the opening end of the slider. The lateral distance separating the projections at the opening end of the slider is greater than the lateral distance separating the projections at the closing end. In the case of the opening end, the projections must be separated by a distance sufficient to separate and disengage the zipper parts.

Figure 13:
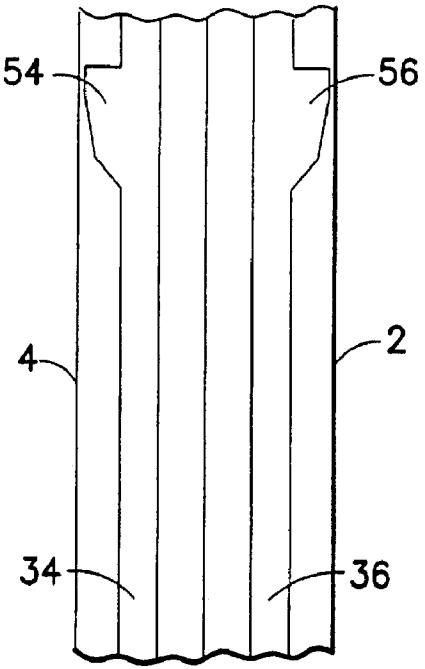
FIG. 13 is a schematic showing a fragmentary top view of a portion of a zipper for use with the slider depicted in FIG. 12.

FIG. 13 shows a top view of a closed portion of a zipper for use with the slider depicted in FIG. 12. Again the groove 34 in zipper part 4 has a widened region 54 at or near the end of the groove, while groove 36 in zipper part 2 has a widened region 56 at or near the end of the groove. The widened portions 54 and 56 of the zipper grooves are proximal to a stomped end of the zipper, not shown in FIG. 13.

Figure 14:
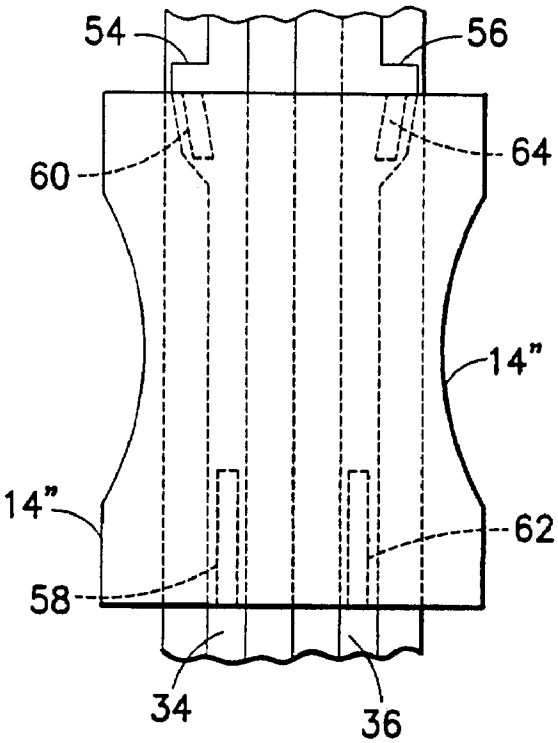
FIG. 14 is a schematic showing the slider of FIG. 12 mounted to the zipper shown in FIG. 13.

FIG. 14 shows the slider of FIG. 12 mounted to the zipper shown in FIG. 13. The widened portions 54 and 56 at the end of grooves 34 and 36 provide clearance for the slider projections 60 and 64 respectively. As a result of this clearance, the opening end of the slider again exerts no opening force on the zipper parts when the slider is parked in the zipper maximally closed position.

In a case where a grooved slider rides on a pair of projections projecting upward from the tops of the respective zipper parts, slider end stops may be formed at the ends of the zipper. For example, one or both projections could be provided with slider end stops at both ends by fusing a body of plastic material to each end section of the zipper part or by crushing and fusing the end section by application of ultrasonic wave energy. Alternatively, any other known method for forming slider end stops could be used.

In accordance with a further alternative, the slider could have one projection and one groove for respectively interlocking with a groove formed in one zipper part and a projection projecting from the other zipper part.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

The invention claimed is:

1. An article of manufacture comprising a zipper and a slider mounted to said zipper, said zipper comprising first and second mutually interlockable zipper parts joined along respective sections proximal to respective ends of said zipper, and said slider being movable between first and second slider park positions for engaging or disengaging mutually confronting portions of said first and second zipper parts, wherein:

said first zipper part comprises a first groove that opens onto a top surface of said first zipper part, and said second zipper part comprises a second groove that opens onto a top surface of said second zipper part; and said slider comprises a base and first through fourth projections depending from said base, said base being disposed above the tops of said first and second zipper parts, said first and third projections being inserted in and interlocked with said first groove in said first zipper part, and said second and fourth projections being inserted in and interlocked with said second groove in said second zipper part, said first through fourth projections sliding in said first and second grooves during slider travel along said zipper, said first and second projections being separated by a first distance, and respective portions of said third and fourth projections that are furthest apart being separated by a second distance greater than said first distance, said first and second distances being measured in a direction transverse to a direction of travel of said slider, said second distance being great enough to cause adjoining sections of said first and second zipper parts to disengage during slider travel.

2. The article as recited in claim 1, wherein said third and fourth projections are mutually diverging in a direction parallel to said direction of travel and away from said first and second projections.

3. The article as recited in claim 1, wherein said slider further comprises first and second side walls depending downward from opposing sides of said base, said first and second side walls of said slider being disposed laterally outside said zipper.

4. The article as recited in claim 1, wherein said zipper is a string zipper, further comprising a receptacle, said receptacle comprising first and second walls, wherein an upper margin of said first wall is joined to a back surface of said first zipper part, and an upper margin of said second wall is joined to a back surface of said second zipper part.

5. The article as recited in claim 1, wherein said zipper further comprises a first flange having one end connected to a bottom of said first zipper part, and a second flange having one end connected to a bottom of said second zipper part, further comprising a receptacle, said receptacle comprising first and second walls, wherein an upper margin of said first wall is joined to said first flange, and an upper margin of said second wall is joined to said second flange.

6. The article as recited in claim 1, wherein said first and second grooves become wider at an end of said zipper where said slider is parked when said zipper is maximally closed, said widened sections providing sufficient clearance for said third and fourth projections of said slider that said zipper is closed along its entire length.

7. An article of manufacture comprising a receptacle comprising mutually confronting first and second walls having respective upper portions that form a mouth, a string zipper installed in said mouth of said receptacle, and a slider mounted to said zipper, said string zipper comprising first and second mutually interlockable zipper parts without flanges, said first zipper part comprising a first base having a front and a back on opposite sides thereof, and a rib projecting from said front of said first base, said rib having a cross section that is constant in shape along a section of said first zipper part, said upper portion of said first wall being joined to said back of said first base, and said second zipper part comprising a second base having a front and a back on opposite sides thereof, and a first groove projecting from said front of said second base, said first groove having a cross section that is constant in shape along a section of said second zipper part, said upper portion of said second wall being joined to said back of said second base, said first groove comprising mutually opposing first and second lips, said rib being interengaged with said first and second lips when said zipper is closed and being disengaged when said zipper is open, and said slider being movable in opposite directions along said zipper for respectively causing said rib to interengage with or disengage from said first and second lips, wherein:

said first zipper part comprises a second groove that opens onto a top surface of said first zipper part, and said second zipper part comprises a third groove that opens onto a top surface of said second zipper part; and said slider comprises a base and first and second projections depending from said base, said base being disposed above the tops of said first and second zipper parts, said first projection being inserted in and interlocked with said second groove in said first zipper part, and said second projection being inserted in and interlocked with said third groove in said second zipper part, said first and second projections sliding along in said second and third grooves respectively during slider travel along said zipper, and said slider having no portions confronting said upper portions of said first and second walls of said receptacle.

8. The article as recited in claim 7, wherein said first and second projections comprise respective portions that are mutually diverging in a direction toward an opening end of said slider.

9. The article as recited in claim 8, wherein said first and second projections diverge with increasing distance from said base in an opening section of said slider.

10. The article as recited in claim 8, wherein said first and second projections converge with increasing distance from said base in an opening section of said slider.

11. The article as recited in claim 7, wherein said slider further comprises third and fourth projections depending from said base, said fourth projection being inserted in and interlocked with said second groove in said first zipper part, and said fourth projection being inserted in and interlocked with said third groove in said second zipper part, said first and second projections sliding in said second and third grooves respectively during slider travel along said zipper, said first and second projections causing adjacent sections of said first and second zipper parts to interlock as said slider is moved in a zipper closing direction, and said third and fourth projections causing adjacent sections of said first and second zipper parts to disengage as said slider is moved in a zipper opening direction.

12. An article of manufacture comprising a zipper and a slider mounted to said zipper, said zipper comprising first and second mutually interlockable zipper parts, said first zipper part comprising a rib having a cross section that is constant in shape along a section of said first zipper part, said second zipper part comprising a first groove having a cross section that is constant in shape along a section of said second zipper part, said first groove comprising mutually opposing first and second lips at a mouth thereof, said rib being interengaged with said first and second lips when said zipper is closed and being disengaged when said zipper is open, and said slider being movable in opposite directions along said zipper for respectively causing said rib to interengage with or disengage from said first and second lips, wherein:

said first zipper part comprises a second groove that opens onto a top surface of said first zipper part, and said second zipper part comprises a third groove that opens onto a top surface of said second zipper part;

said slider comprises a base and first and second projections depending from said base, said base being disposed above the tops of said first and second zipper parts, said first projection being inserted in and interlocked with said second groove in said first zipper part, and said second projection being inserted in and interlocked with said third groove in said second zipper part, said first and second projections sliding along in said second and third grooves respectively during slider travel along said zipper; and said second and third grooves become wider in respective widened sections disposed at an end of said zipper where said slider is parked when said zipper is maximally closed, said widened sections providing sufficient clearance for respective end portions of said first and second projections that said zipper is closed along its entire length.

13. An article of manufacture comprising a receptacle comprising mutually confronting first and second walls having respective upper portions that form a mouth, a string zipper installed in said mouth of said receptacle, and a slider mounted to said zipper, said string zipper comprising first and second mutually interlockable zipper parts without flanges, said first zipper part comprising a first base having a front and a back on opposite sides thereof, and a rib projecting from said front of said first base, said rib having a cross section that is constant in shape along a section of said first zipper part, said upper portion of said first wall being joined to said back of said first base, and said second zipper part comprising a second base having a front and a back on opposite sides thereof, and a first groove projecting from said front of said second base, said first groove having a cross section that is constant in shape along a section of said second zipper part, said upper portion of said second wall being joined to said back of said second base, said first groove comprising mutually opposing first and second lips, said rib being interengaged with said first and second lips when said zipper is closed and being disengaged when said zipper is open, and said slider being movable in opposite directions along said zipper for respectively causing said rib to interengage with or disengage from said first and second lips, wherein:

said first zipper part comprises a first projection having a cross section that is constant in shape along said section of said first zipper part and projecting upward from a top surface of said first zipper part, and said second zipper part comprises a second projection having a cross section that is constant in shape along said section of said second zipper part and projecting upward from a top surface of said second zipper part, wherein the constant shape of each of said first and second projections comprises a respective enlarged head; and said slider comprises a base and first and second grooves formed in said base, said base being disposed above the tops of said first and second zipper parts, said first projection being inserted in and interlocked with said first groove of said slider, and said second projection being inserted in and interlocked with said second groove of said slider, said first and second grooves of said slider sliding along said first and second projections respectively during slider travel along said zipper, and said slider having no portions confronting said upper portions of said first and second walls of said receptacle.

14. The article as recited in claim 13, wherein said first and second grooves comprise respective portions that are mutually diverging in a direction toward an opening end of said slider.

15. An article of manufacture comprising a receptacle comprising mutually confronting first and second walls having respective upper portions that form a mouth, a string zipper installed in said mouth of said receptacle, and a slider mounted to said zipper, said string zipper comprising first and second zipper parts without flanges, said first zipper part comprising a first base having a front and a back on opposite sides thereof, and a rib projecting from said front of said first base, said rib having a cross section that is constant in shape along a section of said first zipper part, said upper portion of said first wall being joined to said back of said first base, and said second zipper part comprising a second base having a front and a back on opposite sides thereof, and a first groove projecting from said front of said second base, said first groove having a cross section that is constant in shape along a section of said second zipper part, said upper portion of said second wall being joined to said back of said second base, said first groove comprising mutually opposing first and second lips, said rib being interengaged with said first and second lips when said zipper is closed and being disengaged when said zipper is open, and said slider comprising a base overlying said first and second zipper parts and bridging an interstice between said first and second zipper parts, said slider having no portions confronting said upper portions of said first and second walls of said receptacle, and said article further comprising:

means for coupling said slider to said first and second zipper parts, said coupling means allowing said slider to slide along said zipper in opening and closing directions for respectively causing said rib to interengage with or disengage from said first and second lips; and means for stopping said slider at zipper maximally opened and zipper maximally closed slider park positions respectively, wherein said coupling means comprise the following coupling elements:

first and second projections that project generally perpendicular to said base of said slider when said slider is coupled to said zipper, each of said first and second projections having a constant cross-sectional shape with an enlarged head;

first and second grooves that receive and interlock with said first and second projections respectively when said slider is coupled to said zipper, two of said coupling elements being disposed on said slider, one of said coupling elements being disposed on said first zipper part, and one of said coupling elements being disposed on said second zipper part.

16. The article as recited in claim 15, wherein said first and second projections are disposed on said slider, and said first and second grooves are formed in said first and second zipper parts respectively.

17. The article as recited in claim 15, wherein said first and second grooves are disposed on said slider.

18. The article as recited in claim 15, wherein said two of said coupling elements disposed on said slider comprise respective portions that are mutually diverging in a direction toward an opening end of said slider.

19. The article as recited in claim 15, wherein said first projection and said second groove are disposed on said slider, and said second projection and said first groove are formed in said first and second zipper parts respectively.

* * * * *